US007520246B2

(12) United States Patent
Matsuda et al.

(10) Patent No.: US 7,520,246 B2
(45) Date of Patent: Apr. 21, 2009

(54) POWER SUPPLY ANTENNA AND POWER SUPPLY METHOD

(75) Inventors: Ryuichi Matsuda, Takasago (JP); Noriaki Ueda, Kobe (JP); Kazuto Yoshida, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 574 days.

(21) Appl. No.: 11/240,358

(22) Filed: Oct. 3, 2005

(65) Prior Publication Data

US 2006/0027168 A1 Feb. 9, 2006

Related U.S. Application Data

(62) Division of application No. 09/881,670, filed on Jun. 18, 2001, now abandoned.

(30) Foreign Application Priority Data

Jun. 23, 2000 (JP) ..... 2000-189202

(51) Int. Cl.
*C23C 16/00* (2006.01)
*C23F 1/00* (2006.01)
*H01L 21/306* (2006.01)

(52) U.S. Cl. ..... 118/723 I; 156/345.48

(58) Field of Classification Search ..... 118/715, 118/722, 723 R, 723 I; 156/345.48
See application file for complete search history.

(56) References Cited

U.S. PATENT DOCUMENTS

| | | | | |
|---|---|---|---|---|
| 5,401,318 | A * | 3/1995 | Pearson | 118/723 AN |
| 5,401,350 | A | 3/1995 | Patrick et al. | |
| 5,571,366 | A | 11/1996 | Ishii et al. | |
| 5,619,103 | A | 4/1997 | Tobin et al. | |
| 5,622,635 | A * | 4/1997 | Cuomo et al. | 216/68 |
| 5,637,961 | A * | 6/1997 | Ishii et al. | 315/111.51 |
| 5,648,701 | A | 7/1997 | Hooke et al. | |
| 5,759,280 | A | 6/1998 | Holland et al. | |
| 5,800,619 | A | 9/1998 | Holland et al. | |
| 5,938,883 | A | 8/1999 | Ishii et al. | |
| 6,180,019 | B1 | 1/2001 | Kazumi et al. | |
| 6,288,493 | B1 | 9/2001 | Lee et al. | |
| 6,463,875 | B1 | 10/2002 | Chen et al. | |
| 2004/0011467 | A1 | 1/2004 | Hemker et al. | |

FOREIGN PATENT DOCUMENTS

| | | |
|---|---|---|
| EP | 0 792 947 A2 | 9/1997 |
| JP | 06-267903 | 9/1994 |
| JP | 07-201811 | 8/1995 |
| JP | 9-199295 | 7/1997 |
| JP | 10-125497 | 5/1998 |
| JP | 2000-068254 | 3/2000 |

(Continued)

*Primary Examiner*—Parviz Hassanzadeh
*Assistant Examiner*—Maureen G Arancibia
(74) *Attorney, Agent, or Firm*—Oblon, Spivak, McClelland, Maier & Neustadt, P.C.

(57) ABSTRACT

A power supply antenna comprises a plurality of coils disposed concentrically. Power supply portions formed at opposite ends of the respective coils are located in different phases on the same plane such that spacing between the adjacent power supply portions is equal. The power supply antenna can generate a uniform electric field and a uniform magnetic field, although it has the plural coils.

8 Claims, 12 Drawing Sheets

FOREIGN PATENT DOCUMENTS

| | | |
|---|---|---|
| JP | 2001-85196 | 3/2001 |
| JP | 2002-519861 | 7/2002 |
| KR | 2000-0053680 | 9/2000 |
| WO | WO 00/00993 | 1/2000 |
| WO | WO 00/36632 | 6/2000 |

* cited by examiner

Absobed Power Distribution at z =0.16

POWER SUPPLY ANTENNA AND POWER SUPPLY METHOD

CROSS-REFERENCE TO RELATED APPLICATIONS

This application is a divisional of U.S. patent application Ser. No. 09/881,670, filed on Jun. 18, 2001, and claims priority to Japanese Patent Application No. 2000-189202, filed on Jun. 23, 2000. The entire contents of these applications are incorporated herein by reference in their entirety.

BACKGROUND OF THE INVENTION

1. Field of the Invention

This invention relates to a power supply antenna and a power supply method. More specifically, the invention relates to a power supply antenna which is useful for a plasma.

2. Description of the Related Art

In the field of semiconductor manufacturing, film formation using a plasma assisted chemical vapor deposition (plasma CVD) system is currently known. The plasma CVD system is designed to introduce a starting gas, which will be materials of a film, into a deposition chamber inside a vessel to convert it into the state of a plasma, and promote a chemical reaction on the surface of a substrate by active excited atoms or molecules in the plasma to deposit a film. To create the plasma state in the deposition chamber, the vessel is provided with an electromagnetic wave transparent window, and a power supply antenna located outside the vessel is supplied with an electric power to enter an electromagnetic wave through the electromagnetic wave transparent window.

FIG. 11 is a view showing a power supply antenna according to an earlier technology, which is used in the above-described semiconductor manufacturing apparatus. As shown in this drawing, a power supply antenna 01 is a single loop antenna with a single power supply portion 01A. This power supply antenna 01 is usually disposed at the top of a cylindrical vacuum vessel 02 so as to convert a gas, which has been injected into the vacuum vessel 02, into a plasma, thereby depositing a film on a wafer 04 borne on an electrostatic chuck 03 and disposed below. If cylindrical coordinates with the center of the wafer 04 as an origin O are assumed, a coordinate axis r represents a radial direction, a coordinate axis Z represents a cylindrical axial direction, and θ represents a circumferential direction.

With the single loop antenna having the power supply portion 01A at one location, as described above, the value of an electric current flowing through each part of the power supply antenna 01 is, needless to say, constant. In such a current distribution, distribution of absorption (in a radial direction), by plasma, of an electromagnetic wave from the power supply antenna 01 shows marked nonuniformity. FIG. 12 shows the electromagnetic wave energy absorption distribution of plasma determined by numerically finding the propagation in the plasma of the electromagnetic wave (i.e., solving a wave equation of the electromagnetic wave) from the power supply antenna 01. The horizontal axis of FIG. 12 represents the position (m) in the diametrical direction relative to the origin as the center of the power supply antenna 01 (origin O as the center of the wafer 04). The vertical axis represents the amount of absorption of the electromagnetic wave energy ($W/m^3$). The characteristics of a solid line in FIG. 12 show an absorbed power distribution at the position 0.16 (m) vertically (in the Z direction) above the surface of the wafer 04 illustrated in FIG. 11. Z=0.16 means this fact (the same will be true of the description to follow) As will be seen in FIG. 12, strong peaks appear around points corresponding to a half of the radius of the vacuum vessel 02, and energy absorptions are very weak at the center and on the periphery of the vacuum vessel 02. In a region near the center and distant from the wall of the vacuum vessel 02, the plasma diffuses toward the center where the temperature and the density are low, and the distribution of the diffusing plasma relatively flattens over time. In a peripheral region close to the wall, the plasma escapes to this wall. Thus, the plasma cannot be flattened in the peripheral region. As a result, the temperature and density of the plasma are low in the peripheral region. Hence, film deposition cannot ensure the uniformity of the film thickness throughout the surface of the wafer 04. This is confirmed experimentally.

SUMMARY OF THE INVENTION

The present invention has been accomplished in consideration of the above problems with the earlier technology. It is the object of the invention to provide a power supply antenna which can flatten the radial electromagnetic wave energy absorption distribution of plasma, and which has even a plurality of coils, but can generate a uniform electric field and a uniform magnetic field; a power supply apparatus having the power supply antenna; a semiconductor manufacturing apparatus having the power supply antenna or the power supply apparatus; and a power supply method using the power supply antenna or the power supply apparatus.

The power supply antenna according to the present invention is characterized by the following aspects:

1) A power supply antenna comprising a plurality of coils disposed concentrically, the plurality of coils being prepared by bending a plurality of conductors each into the form of an arc, wherein power supply portions formed at opposite ends of the respective coils so as to be connected to a high frequency power source are located in different phases on the same plane.

According to this aspect, a nonuniform electric field generated at the power supply terminal, such as $E_z$ (to be described later), can be dispersed. Thus, the power supply antenna can generate a more uniform electric field and a more uniform magnetic field, i.e., a more uniform electromagnetic wave, than when the plurality of power supply portions are concentrated at one location in the circumferential direction of the coils. Consequently, it becomes possible to uniformize the distribution in the radial direction (r direction) of the density of a plasma generated upon heating with the electromagnetic wave.

2) In the power supply antenna described in the aspect 1), the radii or thicknesses of the respective coils may be adjusted to vary self inductances and mutual inductances, thereby varying electric currents flowing through the respective coils so that the distribution of energy absorbed to a plasma can be adjusted.

According to this aspect, currents flowing through the respective coils can be adjusted. Thus, the plasma distribution can be made flatter.

3) In the power supply antenna described in the aspect 1) or 2), at least one of the coils may be disposed on a plane other than the same plane to vary the mutual inductances so that the distribution of energy absorbed to a plasma can be adjusted.

According to this aspect, the distance between the coil disposed on the plane other than the same plane and the plasma is increased or decreased. Thus, the absorption of the electromagnetic wave to the plasma decreases or increases. Consequently, a heating distribution of the plasma can be shaped to achieve a uniform absorption distribution, whereby the distribution in the radial direction (r direction) of the plasma can be uniformized.

4) In the power supply antenna described in any one of the aspects 1) to 3), the spacing between the adjacent power supply portions in the respective coils may be equal.

According to this aspect, disturbances in the electric field and the magnetic field due to the $E_z$ can be dispersed most satisfactorily in the circumferential direction. Thus, the effects of the invention in the aspect 1) can be obtained most markedly. That is, an electromagnetic wave most uniform in the circumferential direction (θ direction) can be generated.

5) A power supply apparatus including a power supply antenna comprising a plurality of coils disposed concentrically, the plurality of coils being prepared by bending a plurality of conductors each into the form of an arc, and matching means having capacitors connected in parallel to the respective coils of the power supply antenna, and wherein the matching means has a first tubular capacitor and a second tubular capacitor each having electrodes at axially opposite ends thereof, and also has a first electrode, a second electrode and a third electrode disposed parallel to the power supply antenna, with electrical insulation being established with respect to each other, one of the electrodes of the first capacitor being connected to the first electrode, one of the electrodes of the second capacitor being connected to the second electrode, and the other electrodes of the first and second capacitors being connected to the third electrode.

According to this aspect, a uniform electromagnetic wave can be generated by the power supply apparatus ensuring impedance matching to the power supply antenna. Thus, a uniform plasma can be effectively generated by the electromagnetic wave with a uniform maximum intensity.

6) In the power supply apparatus described in the aspect 5), the first electrode and the third electrode of the matching means may be disposed at opposite ends thereof, the second electrode comprising a flat plate portion having through-holes and a concave portion protruding from the flat plate portion toward the first electrode may be disposed between the first electrode and the third electrode, the first capacitor may pass through the through-hole and may have one of the electrodes thereof connected to the first electrode, the second capacitor may fit into the concave portion and may have one of the electrodes thereof connected to the second electrode, and at least one of power supply portions of each of the coils constituting the power supply antenna may pass through at least the first electrode and establish an electrically connected relationship with the second electrode.

According to this aspect, the degree of freedom of selecting the positions of connection between the plurality of power supply portions in different phases and the first and second electrodes is maximized. Thus, the lengths of the power supply portions are rendered as short as possible to minimize power losses at the sites of connection. In this state, electrical connection between the power supply antenna and the first and second electrodes can be established.

7) In the power supply apparatus described in the aspect 5) or 6), the power supply antenna may be the same as the power supply antenna described in the aspect 1). Thus, the same effects as those of the invention described in the aspect 1) can be obtained.

8) In the power supply apparatus described in the aspect 5) or 6), the power supply antenna may be the power supply antenna described in the aspect 2). Thus, the same effects as those of the invention described in the aspect 2) can be obtained.

9) In the power supply apparatus described in the aspect 5) or 6), the power supply antenna may be the power supply antenna described in the aspect 3). Thus, the same effects as those of the invention described in the aspect 3) can be obtained.

10) In the power supply apparatus described in the aspect 5) or 6), the power supply antenna may be the power supply antenna described in the aspect 4). Thus, the same effects as those of the invention described in the aspect 4) can be obtained.

11) A semiconductor manufacturing apparatus comprising a vessel having an electromagnetic wave transparent window, a power supply antenna provided outside the vessel and opposed to the electromagnetic wave transparent window, and a power source for applying a high frequency voltage to the power supply antenna, and being adapted to apply the high frequency voltage from the power source to the power supply antenna to generate an electromagnetic wave, and pass the electromagnetic wave through the electromagnetic wave transparent window into the vessel to generate a plasma, thereby treating the surface of a substrate in the vessel, the semiconductor manufacturing apparatus having the power supply antenna or the power supply apparatus described in any one of the aspects 1) to 10).

According to this aspect, a uniform plasma distribution can be formed in the vessel. Thus, a high quality semiconductor product with a uniform film thickness can be obtained.

12) A power supply method for the power supply antenna, the power supply apparatus, or the semiconductor manufacturing apparatus described in any one of the aspects 1) to 11), wherein the frequency of a high frequency voltage applied to the coil on the outermost periphery of the power supply antenna is made relatively lower than the frequency of a high frequency voltage applied to the other coil, whereby heating of a plasma directly below the coil on the outermost periphery is promoted.

According to this aspect, the amount of electromagnetic energy absorption by the plasma directly below the coil on the outermost periphery can be increased. Thus, a high temperature, high density plasma can be generated even near the wall surface of the vessel.

13) The power supply apparatus described in any one of the aspects 5) to 10), which may include a plurality of types of power sources for supplying high frequency voltages of different frequencies, and wherein the high frequency power source for an output voltage of the lowest frequency may be connected to the coil on the outermost periphery, and the high frequency power source for an output voltage of a relatively high frequency may be connected to the other coil.

According to this aspect, the amount of electromagnetic energy absorption by a plasma directly below the coil on the outermost periphery can be increased. Thus, a high temperature, high density plasma can be generated even near the wall surface of the vessel.

14) The semiconductor manufacturing apparatus described in the aspect 11), which may include a plurality of types of power sources for supplying high frequency voltages of different frequencies, and wherein the high frequency power source for an output voltage of the lowest frequency may be connected to the coil on the outermost periphery, and the high frequency power source for an output voltage of a relatively high frequency may be connected to the other coil.

According to this aspect, the amount of electromagnetic energy absorption by a plasma directly below the coil on the outermost periphery can be increased. Thus, a high temperature, high density plasma can be generated even near the wall surface of the vessel, and the film thickness in the peripheral area of the resulting semiconductor can be made uniform.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of the present invention will now be described in detail with reference to the accompanying drawings, which in no way limit the invention.

Figure 1:
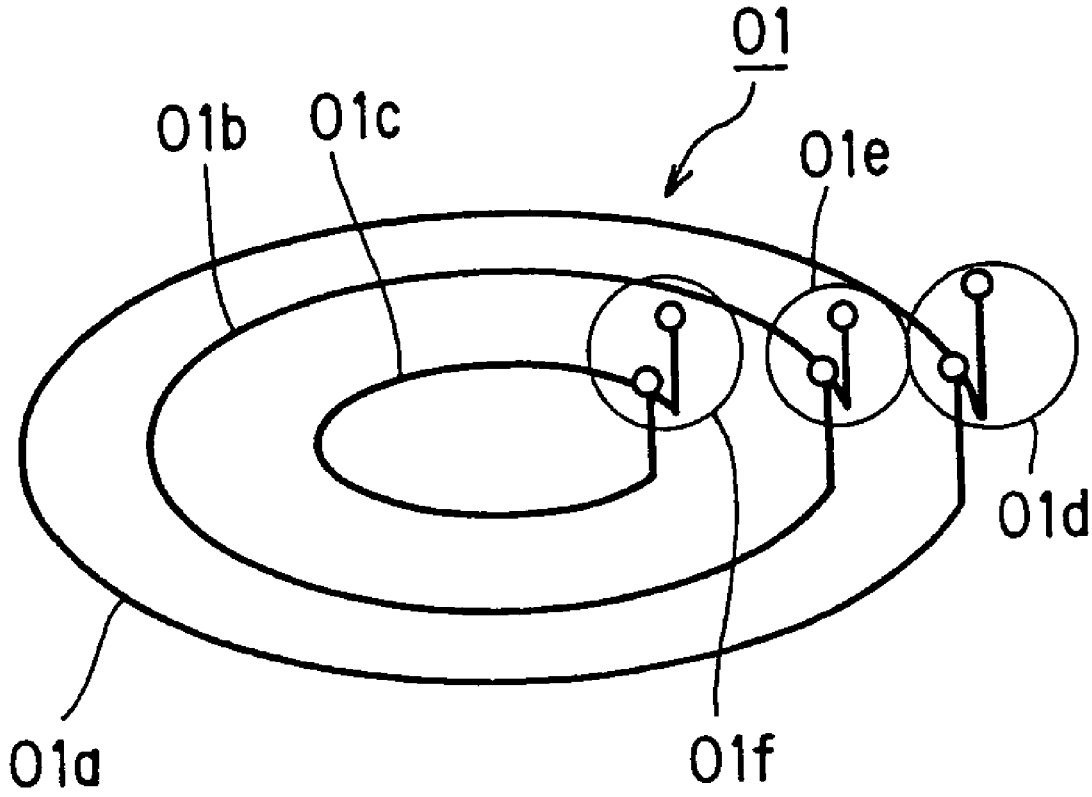
FIG. 1 PRIOR ART
FIG. 1 is an explanation drawing conceptually showing a power supply antenna as a prerequisite for embodiments of the present invention.

As shown in FIG. 1, when a plurality of coils, 01*a*, 01*b* and 01*c*, prepared by bending a plurality of (three in the drawing) conductors each into the form of an arc, rather than a single loop of conductor, are concentrically disposed to constitute a power supply antenna 01, there are various advantages such that electric currents flowing through the coils 01*a*, 01*b* and 01*c* can be controlled independently. (Such advantages will be described in detail later.) However, when power supply portions 01*d*, 01*e* and 01*f* of the coils 01*a*, 01*b* and 01*c* are concentrated at one site in the circumferential direction, as shown in FIG. 1, the resulting electric field and magnetic field may be disturbed. If such disturbances occur, plasma density in a film deposition chamber will be nonuniform, causing nonuniformity of the film thickness distribution of the resulting film. These disturbances in the electric field and the magnetic field are ascribed to the Z-direction component $E_z$ of the electric field that occurs in the rising region in the vertical direction (Z direction) at the power supply portions 01*d*, 01*e* and 01*f*. In the power supply antenna 01 shown in FIG. 1, the disturbances in the electric field and the magnetic field due to the Z-direction component $E_z$ are concentrated at the one site.

Figure 2:
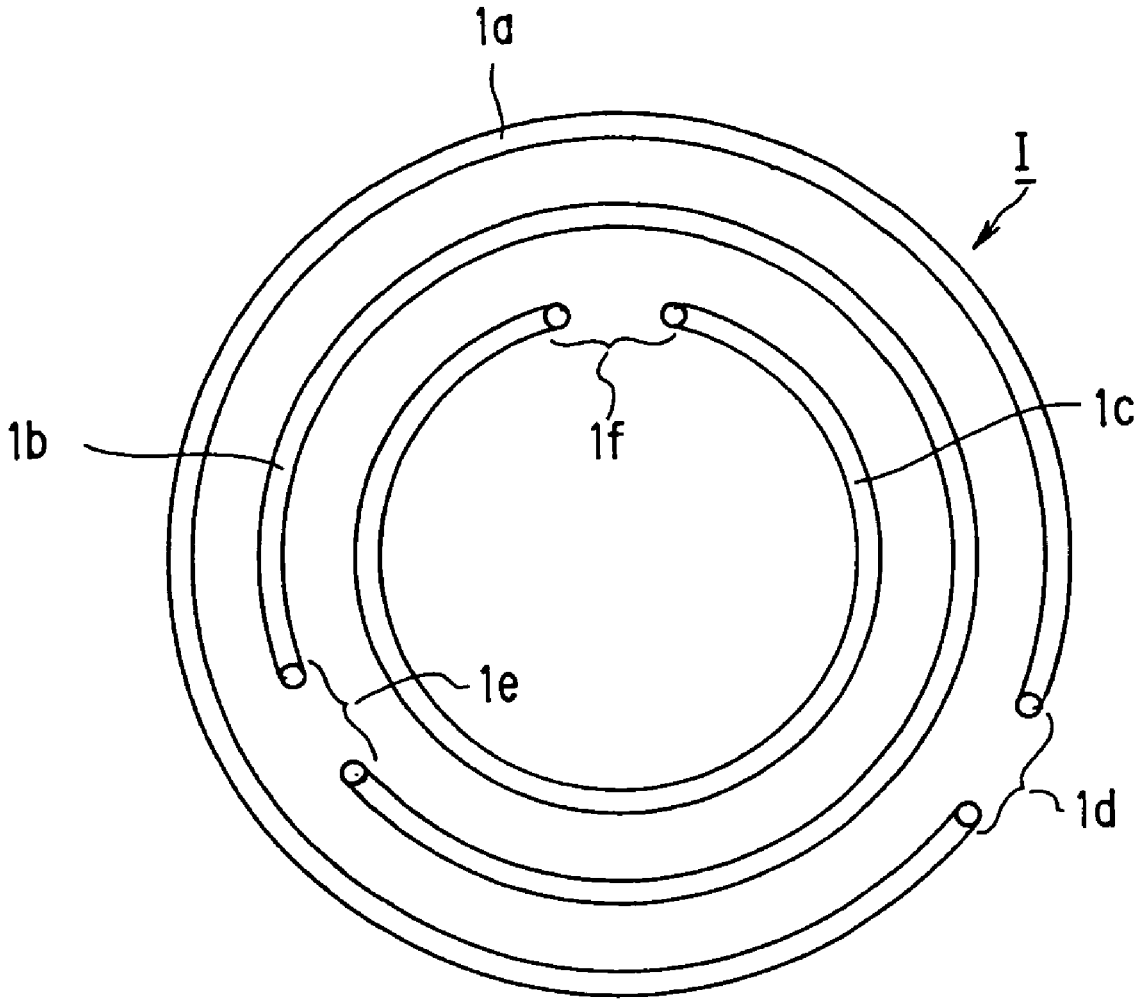
FIG. 2 is a plan view of a power supply antenna according to a first embodiment of the present invention.

In the power supply antenna 01 comprising a concentric arrangement of the plural coils, 01*a*, 01*b* and 01*c* prepared by bending the plurality of conductors each into the form of an arc, the embodiment shown in FIG. 2 proposes that the disturbances in the electric field and the magnetic field at the power supply portions 01*d*, 01*e* and 01*f* be dispersed in the circumferential direction to minimize the influence of the Z-direction component $E_z$. FIG. 2 is a plan view showing a power supply antenna according to a first embodiment of the present invention. As shown in the drawing, a power supply antenna I comprises a concentric arrangement of a plurality of coils, 1*a*, 1*b* and 1*c*, prepared by bending a plurality of (three in the drawing) conductors each into the form of an arc. Power supply portions 1*d*, 1*e* and 1*f* formed at opposite ends of the respective coils 1*a*, 1*b* and 1*c* so as to apply a high frequency voltage are configured to be located in different phases on the same plane. In the present embodiment, the power supply portions 1*d*, 1*e* and 1*f* are disposed such that the spacing between the adjacent power supply portions is an equal spacing (120°).

Figure 3:
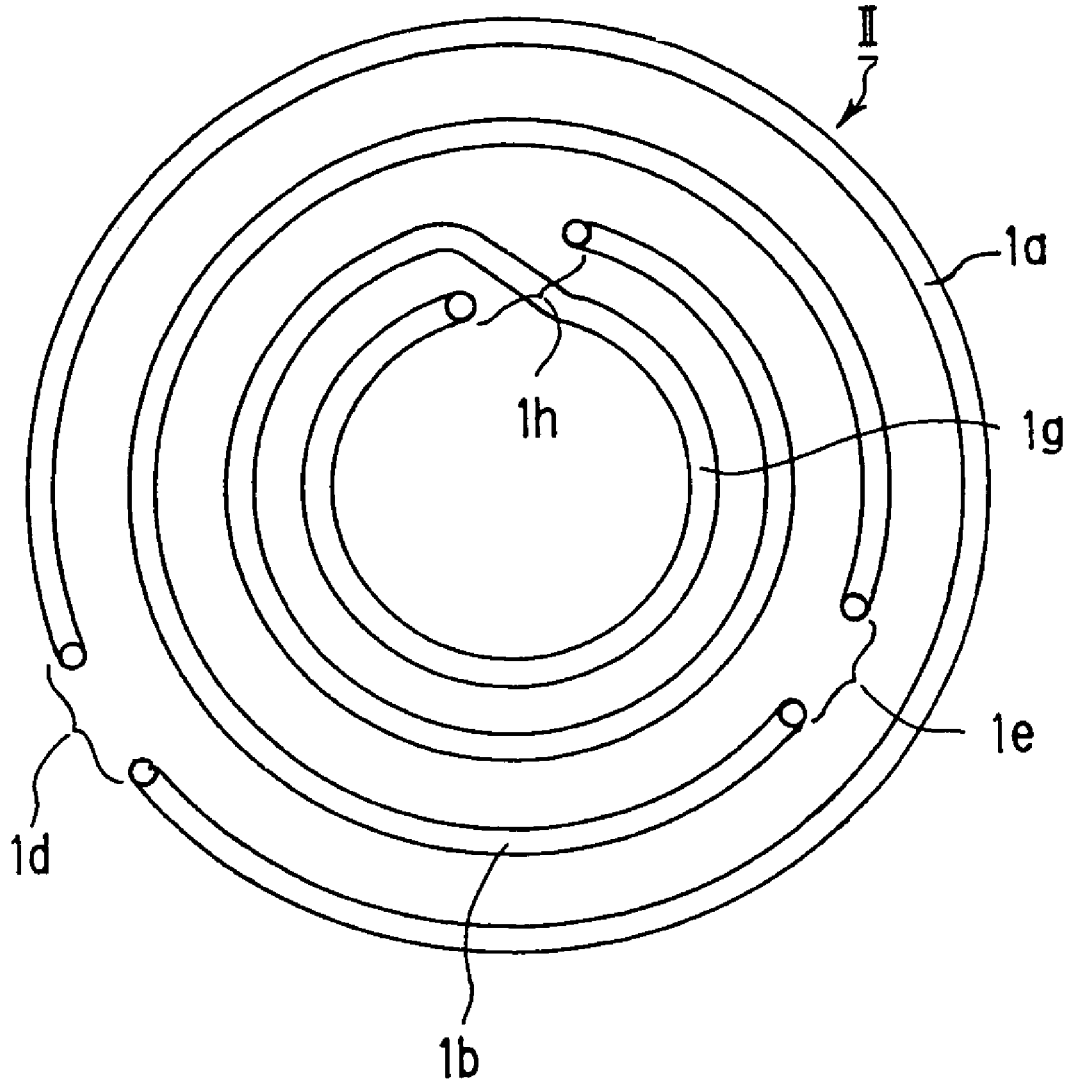
FIG. 3 is a plan view of a power supply antenna according to a second embodiment of the present invention.

FIG. 3 is a plan view of a power supply antenna according to a second embodiment of the present invention. As shown in the drawing, this power supply antenna II has a coil 1*g* on the innermost periphery which is a 2-turn coil. By this configuration, the inductances of respective coils 1*a*, 1*b* and 1*g* can be maximally approximated to each other, because these inductances correlate to the lengths of the respective coils 1*a*, 1*b* and 1*g*. Power supply portions 1*d*, 1*e* and 1*h* in the power supply antenna II are disposed, similar to the embodiment shown in FIG. 2, such that a phase difference of 120° exists between the adjacent power supply portions.

As described above, the power supply antennas I and II shown in FIGS. 2 and 3 are configured such that a certain phase difference is present between the adjacent power supply portions among the power supply portions (1*d*, 1*e*, 1*f*) and (1*d*, 1*e*, 1*h*) of the coils (1*a*, 1*b*, 1*c*) and (1*a*, 1*b*, 1*g*). Thus, the resulting electromagnetic wave can be uniformized. That is, the power supply antennas I and II can disperse a nonuniform electric field, such as the aforementioned Z-direction component $E_z$, generated at the power supply terminal portion, so that a more uniform electric field and a more uniform magnetic field, namely, a uniform electromagnetic wave, can be generated by the power supply antennas I and II. The coils 1*a*, 1*b*, 1*c* need not necessarily be disposed such that equal spacing exists between the adjacent power supply portions of the power supply portions 1*d*, 1*e*, 1*f*. It is clear, however, that the nonuniform electric field can be dispersed most effectively by disposing them with equal spacing. Nor is it necessary to restrict the number of the coils (1*a*, 1*b*, 1*c*), (1*a*, 1*b*, 1*g*) constituting the power supply antennas I, II to three. This number may be determined, where necessary. These power supply antennas I, II, which generate an electromagnetic wave by a high frequency voltage applied by a high frequency power source, are generally connected to the high frequency power source along with a matching device. To supply a maximum power to the power supply antennas I, II, the power supply antennas I, II and the matching device integrally constitute a power supply apparatus in a semiconductor manufacturing apparatus, such as a CVD system.

Figure 4A:
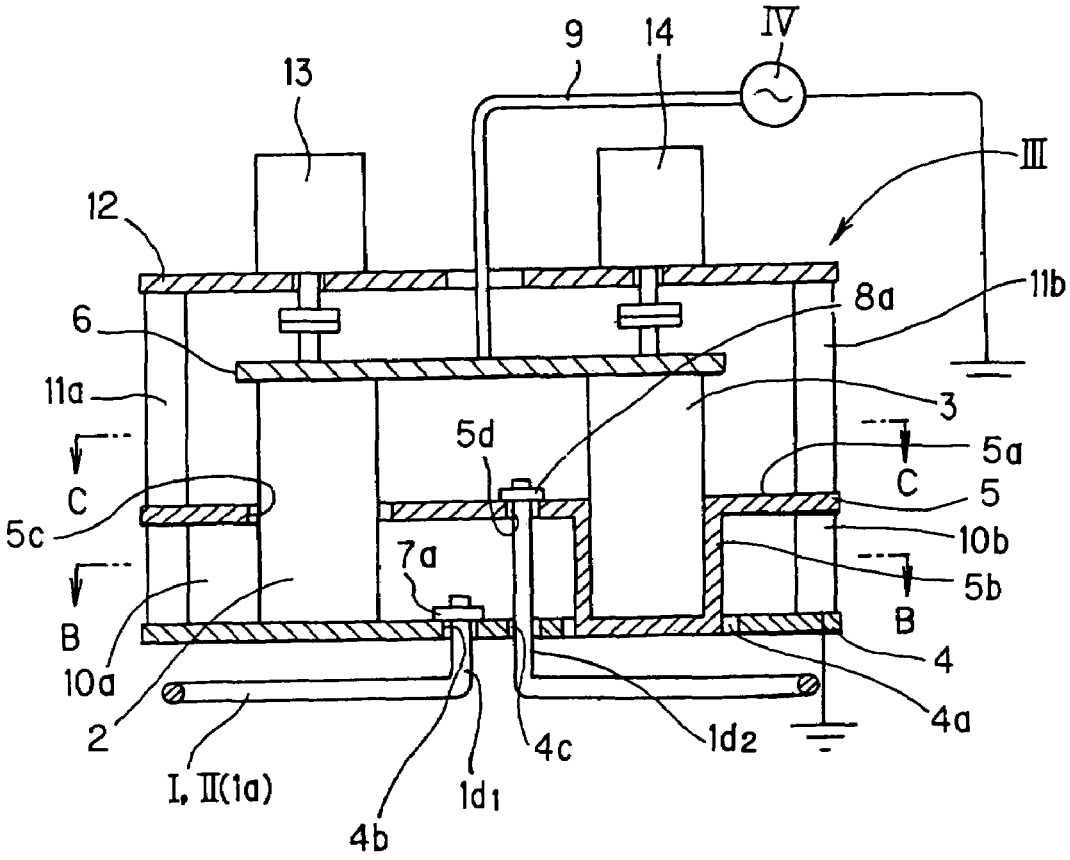
FIGS. 4(*a*) and 4(*b*) are views showing a power supply apparatus according to an embodiment of the present invention, FIG. 4(*a*) being a sectional view taken on line A-A of FIG. 5(*a*), and FIG. 4(*b*) being an equivalent circuit diagram therefor.
Figure 4B:
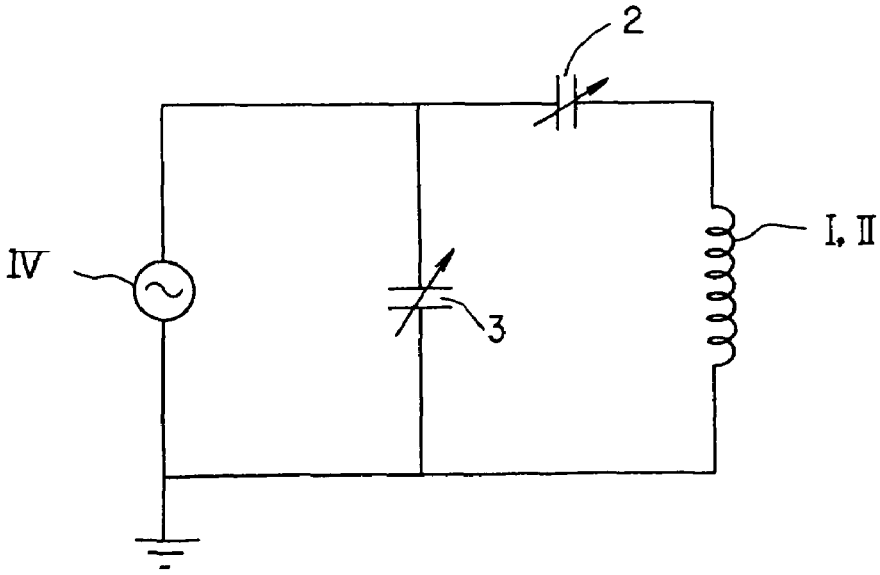
Figure 5A:
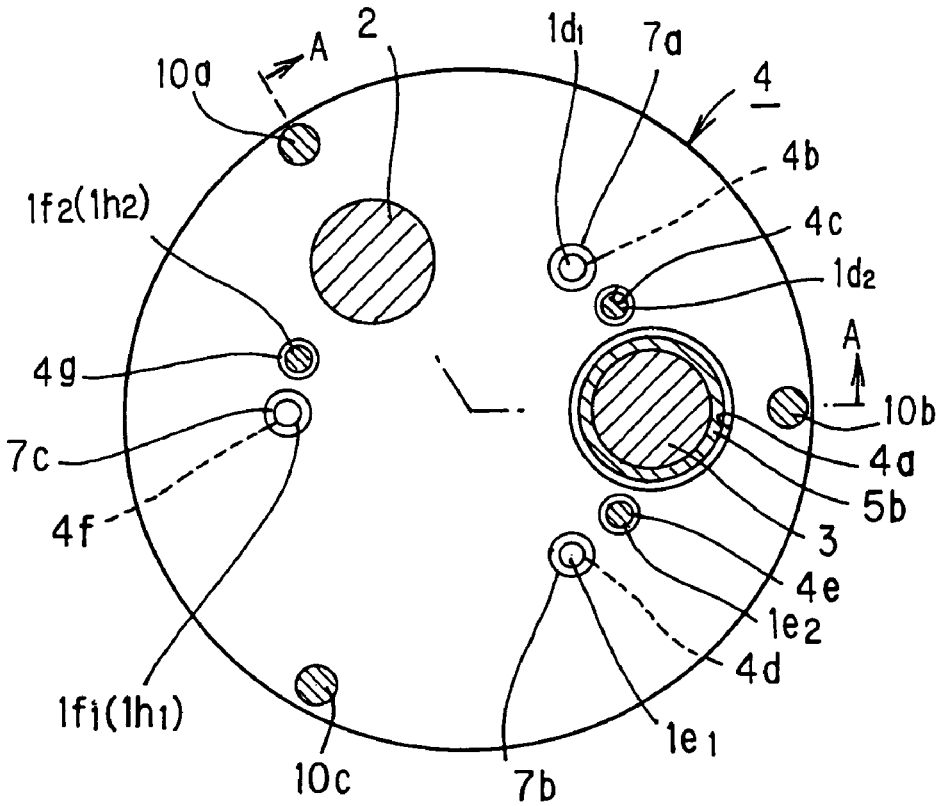
FIGS. 5(*a*) and 5(*b*) are views showing the power supply apparatus according to the embodiment of the present invention, FIG. 5(*a*) being a sectional view taken on line B-B of FIG. 4(*a*), and FIG. 5(*b*) being a sectional view taken on line C-C of FIG. 4(*a*)
Figure 5B:
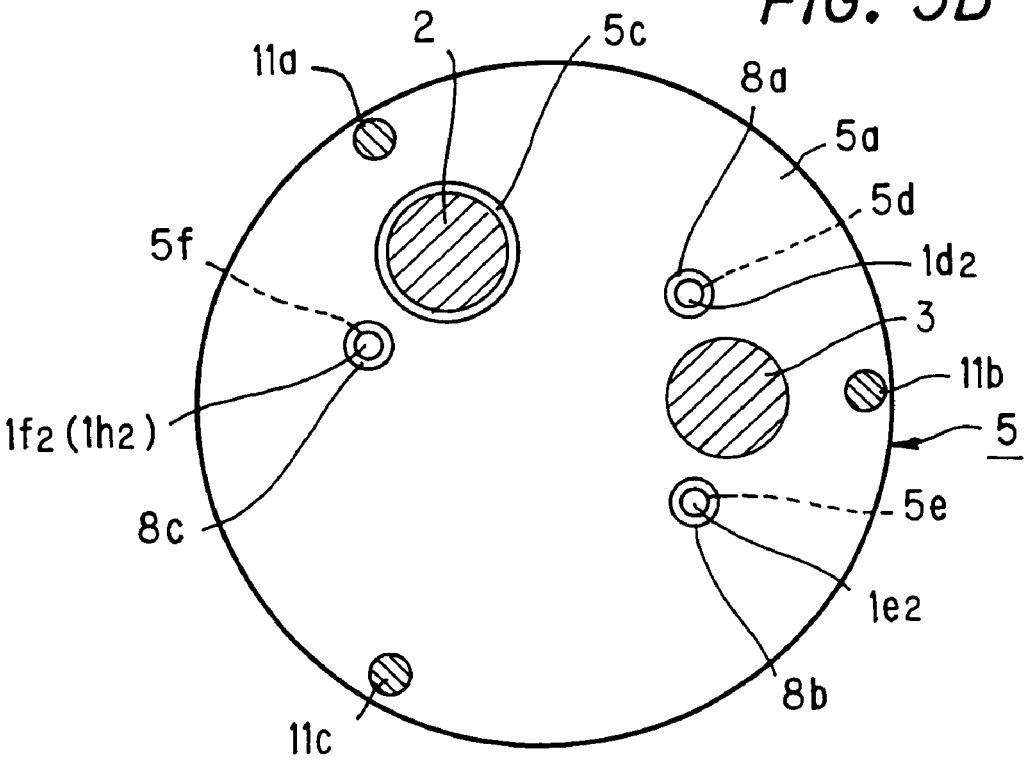

FIGS. 4(*a*) and 4(*b*) and FIGS. 5(*a*) and 5(*b*) show a power supply apparatus according to the present embodiment. FIG. 4(*a*) is a sectional view taken on line A-A of FIG. 5(*a*), FIG. 4(*b*) is an equivalent circuit diagram therefor, FIG. 5(*a*) is a sectional view taken on line B-B of FIG. 4(*a*), and FIG. 5(*b*) is a sectional view taken on line C-C of FIG. 4(*a*). As shown in these drawings, a matching device III has variable capacitors 2 and 3 of the same cylindrical shape, and a first electrode 4, a second electrode 5 and a third electrode 6 in contact with the axially opposite ends of the variable capacitors 2 and 3, with an electrical insulation being ensured with respect to each other. The first electrode 4 and the third electrode 6 are the electrodes at the vertically opposite ends, while the second electrode 5 is located between the first electrode 4 and the third electrode 6. The second electrode 5 has a flat plate portion 5*a* having a through hole 5*c*, and a concave portion 5*b* protruding downward from the flat plate portion 5*a*. The through-hole 5*c* allows the variable capacitor 2 to pass therethrough via a gap and have both ends in contact with the first electrode 4 and the third electrode 6. The concave portion 5*b* is fitted with the variable capacitor 3 so as to bring the lower end surface of the capacitor 3 into contact with the second electrode 5 at a position coplanar with the first electrode 4. The first electrode 4 is also provided with a through-hole 4*a*, and a bottom of the concave portion 5*b* is fitted into the through-hole 4*a* via a gap.

As shown more clearly in FIGS. 5(*a*) and 5(*b*), the first electrode 4 has through-holes (4*b*, 4*c*), (4*d*, 4*e*), (4*f*, 4*g*) for allowing the passage, from below to above, of the power supply portions 1*d*, 1*e*, 1*f* (1*h*) of the coils 1*a*, 1*b*, 1*c* (1*g*) of the power supply antennas I, II (see FIGS. 2 and 3) disposed below the matching device III. One of power supply portions, $\mathbf{1}d_1$, $\mathbf{1}e_1$, $\mathbf{1}f_1$ ($\mathbf{1}h_1$), constituting the respective power supply portions 1*d*, 1*e*, 1*f* (1*h*), are fixed to the first electrode 4 via fixing members 7*a*, 7*b*, 7*c* after passing through the through-holes 4*b*, 4*d*, 4*f* to ensure an electrical connection. The other power supply portions, $\mathbf{1}d_2$, $\mathbf{1}e_2$, $\mathbf{1}f_2$ ($\mathbf{1}h_2$), are fixed to the second electrode 5 via fixing members 8*a*, 8*b*, 8*c* after passing through through-holes 5*d*, 5*e*, 5*f* to ensure an electrical connection. The third electrode 6, an electrode common to the variable capacitors 2, 3, is connected to a high frequency power source IV via a cable 9. As a result, the power supply antenna I (II), the matching device III, and the high frequency power source IV make up an electromagnetic wave generation circuit expressed as an equivalent circuit as illustrated in FIG. 4(*b*).

The spacing between the first electrode 4 and the second electrode 5 is secured by spacers 10*a*, 10*b*, 10*c*. A flat plate portion 12, which secures a predetermined spacing relative to the second electrode 5 by spacers 11*a*, 11*b*, 11*c*, is disposed above the third electrode 6. Motors 13 and 14 corresponding to the variable capacitors 2 and 3, respectively, are disposed on the flat plate portion 12, and the capacitances of the variable capacitors 2 and 3 are adjusted, as desired, by driving the motors 13 and 14. The capacitances of the variable capacitors 2 and 3 are adjusted so that impedance matching to the power supply antennas I, II will be realized by driving of the motors 13, 14.

In the matching device III, the first electrode 4 and the second electrode 5 are nearly disk-like members. Thus, the positions where the power supply portions 1*d*, 1*e*, 1*f* (1*h*) and the first and second electrodes 4 and 5 are connected together can be easily selected. In other words, even if the phases of the power supply portions 1*d*, 1*e*, 1*f* (1*h*) are different from each other, the power supply portions 1*d*, 1*e*, 1*f* (1*h*) can be erected and connected at any positions on the circumferences, so that their distances can be made as short as possible. The voltage supplied to the power supply antenna I or II is a high frequency voltage. Hence, the larger the lengths of the power supply portions 1*d*, 1*e*, 1*f* (1*h*), the more marked loss occurs in the voltage. The number of the power supply portions 1*d*, 1*e*, 1*f* (1*h*) is determined by the number of the coils 1*a*, 1*b*, 1*c* (1*g*) constituting the power supply antennas I, II, and can be flexibly set even if the number of the coils of the power supply antenna is changed. That is, this matching device can be standardized as a matching device for plural types of power supply antennas with different numbers of coils.

However, the matching device of the present invention is not necessarily restricted to that illustrated in FIGS. 4(*a*), 4(*b*) and 5(*a*), 5(*b*). It may be a matching device comprising three (first to third) electrodes, one of the electrodes of one of the capacitors, 2, being connected to the first electrode, one of the electrodes of the other capacitor 3 being connected to the second electrode, and the other electrodes of both capacitors 2 and 3 being connected to the third electrode.

Figure 6:
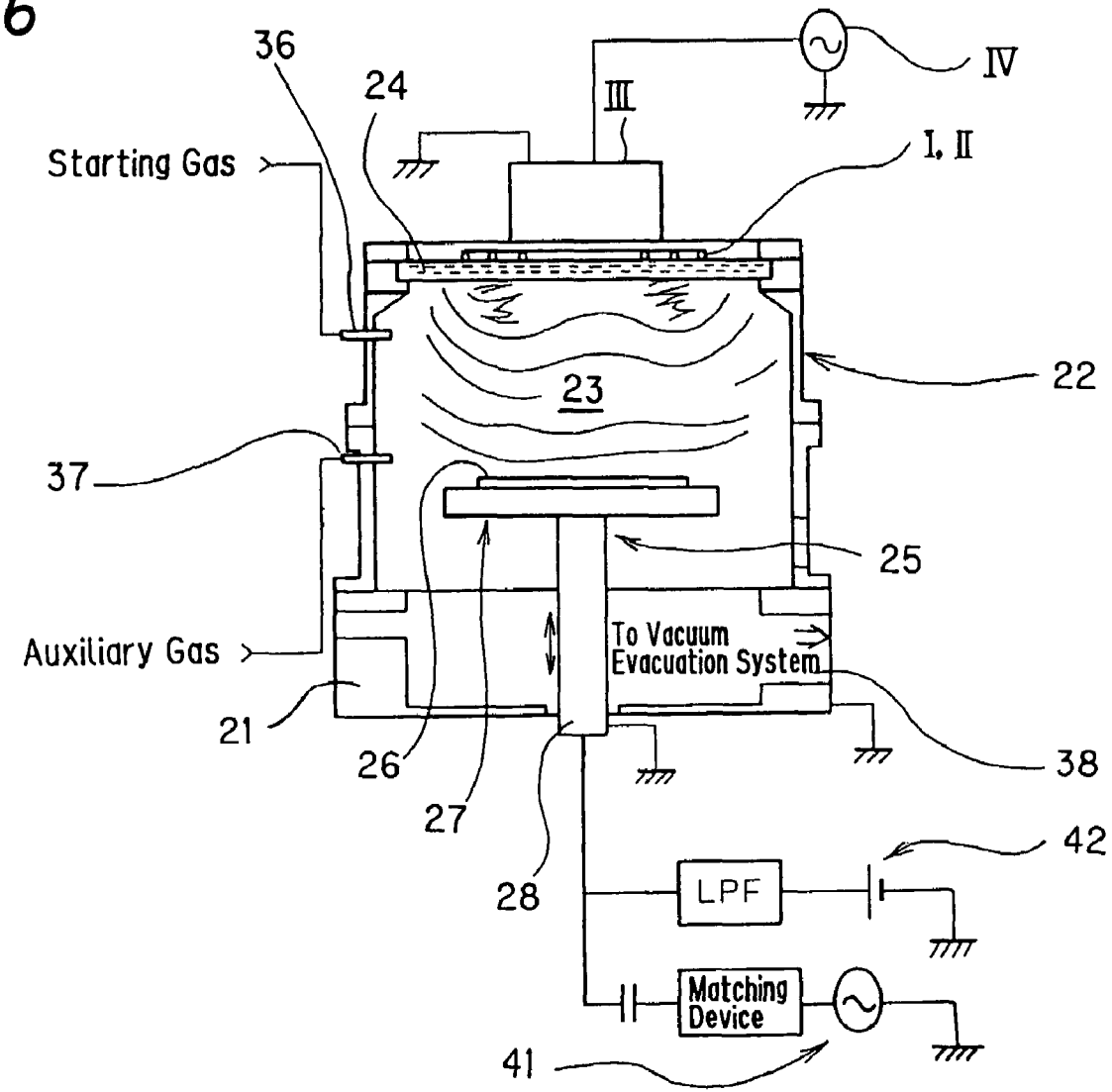
FIG. 6 is an explanation drawing conceptually showing a semiconductor manufacturing apparatus (CVD apparatus)
Figure 7C:
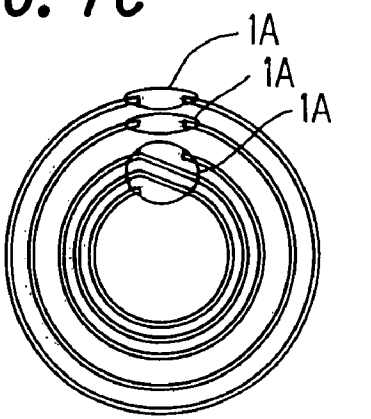
FIGS. 7(*a*) to 7(*d*) are characteristic views showing absorbed power characteristics exhibited when the same electric current was supplied to a plurality of independent coils of the power supply antenna (FIGS. 7(*a*) and 7(*c*)), and when different electric currents were supplied to them (FIGS. 7(*b*) and 7(*d*))
Figure 7D:
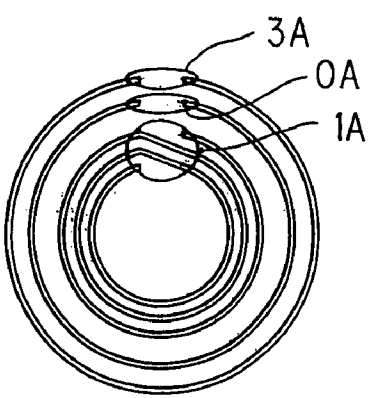
Figure 7A:
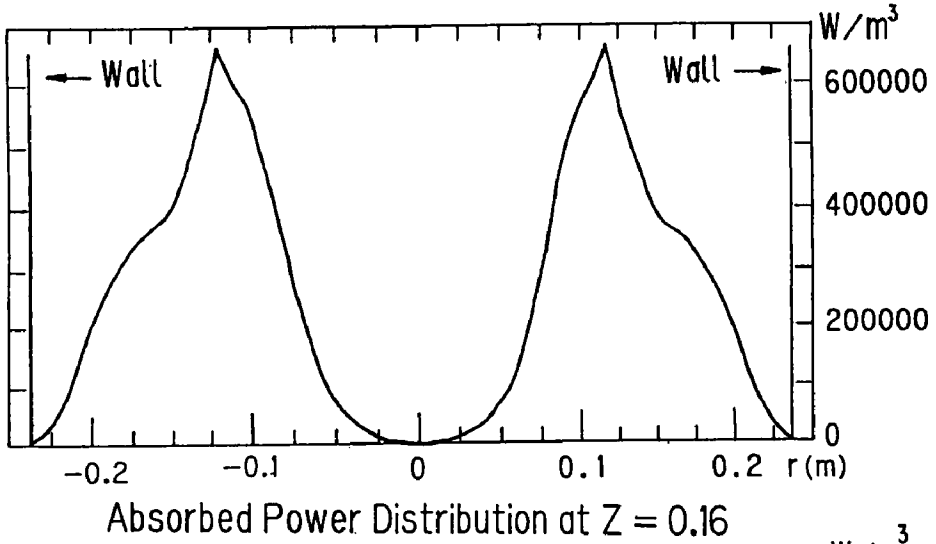
Figure 7B:
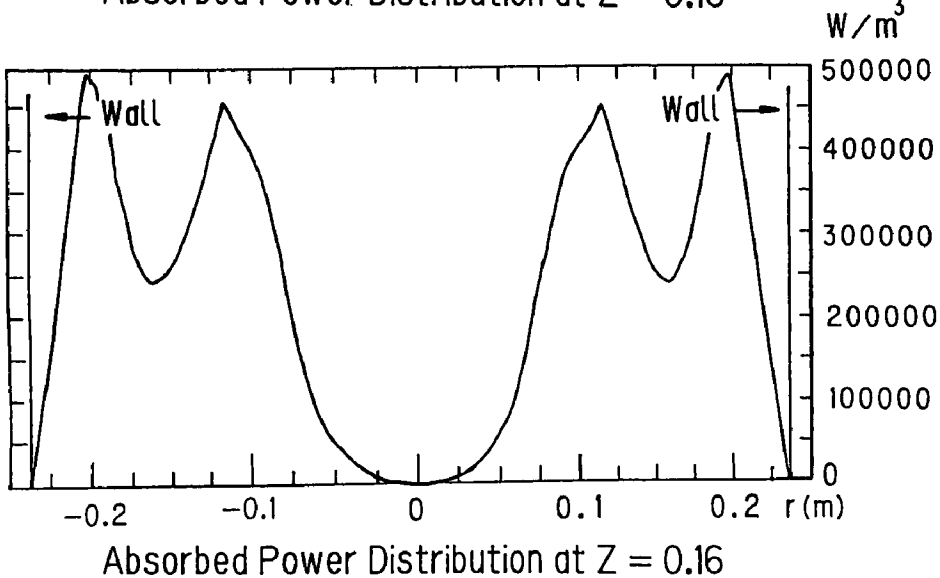

The power supply antennas I, II or power supply apparatuses according to the above-described embodiments, the power supply apparatuses comprising the power supply antennas I, II, matching device III, and high frequency power source IV, are useful when applied as plasma generation means for semiconductor manufacturing apparatuses, for example, CVD systems. A CVD system employing the power supply apparatus will be described based on FIG. 6. FIG. 6 is an explanation drawing conceptually showing the CVD system.

As shown in FIG. 6, a cylindrical vessel 22 of aluminum is provided on a base 21, and a deposition chamber 23 as a treatment chamber is formed in the vessel 22. A circular ceiling plate 24 is provided at the top of the vessel 22, and a wafer support bench 25 is provided in the deposition chamber 23 at the center of the vessel 22. The wafer support bench 25 has a disc-like bearing portion 27 which electrostatically attracts and holds a semiconductor substrate 26. The bearing portion 27 is supported by a support shaft 28. A bias power source 41 and an electrostatic power source 42 are connected to the bearing portion 27 to cause a high frequency wave and an electrostatic force to the bearing portion 27. The wafer support bench 25 can be adjusted vertically to an optimal height, since the entire wafer support bench 25 is movable upward and downward or the support shaft 28 can expand and contract.

A power supply antenna I or II is disposed, integrally with a matching device III, above the ceiling plate 24 as an electromagnetic wave transparent window. A high frequency power source IV is connected to the power supply antenna I or II via the matching device III. A high frequency voltage is supplied to the power supply antenna I or II by the high frequency power source IV to project an electromagnetic wave into the deposition chamber 23 of the vessel 22. The vessel 22 is provided with a gas supply nozzle 36 for supplying a starting gas such as a silane (e.g., $SiH_4$). The starting gas, which will become a film-forming material (e.g., Si), is fed from the gas supply nozzle 36 into the deposition chamber 23. The vessel 22 is also equipped with an auxiliary gas supply nozzle 37 for supplying an auxiliary gas, for example, an inert gas (noble gas) such as argon or helium, oxygen, hydrogen, or $NF_3$ for cleaning. The base 21 is equipped with an exhaust system 38 connected to a vacuum evacuation system (not shown) for evacuating the interior of the vessel 22. The vessel 22 is also provided with a carry-in/carry-out port through which the substrate 26 is carried from a transport chamber into the vessel 22, or the substrate 26 is carried out of the vessel 22 and returned into the transport chamber.

With the above-described plasma CVD system, the substrate 26 is placed on the bearing portion 27 of the wafer support bench 25, and electrostatically attracted thereto. A predetermined flow rate of the starting gas is supplied into the deposition chamber 23 from the gas supply nozzle 36, while a predetermined flow rate of the auxiliary gas is supplied into the deposition chamber 23 from the auxiliary gas supply nozzle 37, and the interior of the deposition chamber 23 is set at a predetermined pressure suitable for the deposition conditions. Then, an electric power is supplied from the high frequency power source IV to the power supply antenna I or II to generate an electromagnetic wave, and an electric power is supplied from the bias power source 41 to the bearing portion 27 to generate a low frequency wave. As a result, the starting gas inside the deposition chamber 23 discharges, and partly changes into the state of a plasma. This plasma strikes other neutral molecules in the starting gas, ionizing or exciting the neutral molecules further. The thus formed active particles are attracted to the surface of the substrate 26 to cause a chemical reaction with high efficiency. The resulting product is deposited to form a CVD film.

FIGS. 7(*a*) and 7(*b*) are characteristic views showing the electromagnetic energy absorption distribution characteristics of the plasma determined by solving the electromagnetic wave equation $$\nabla\times\nabla\times E-(\omega^2/c^2)\cdot K\cdot E=i\omega\mu_0 J_{ext}$$

where $\omega$ is the frequency (13.56 MHz) of the high frequency wave applied to the antenna, $\mu_0$ is the permeability of a vacuum, c is the light velocity, K is the dielectric constant tensor in a cold plasma approximation model, and $J_{ext}$ is the electric current given to the antenna, by numerical analysis. FIG. 7(*a*) shows a case in which the electric current ratio of the three coils of the power supply antenna is constant (1:1:1) as shown in FIG. 7(*c*). FIG. 7(*b*) shows a case in which the electric current ratio is varied (1:0:3) as shown in FIG. 7(*d*). Referring to FIG. 7(*a*), one will see that when the current ratio of the coils is constant, strong absorption peaks appear in regions nearly the center of the radius r of the vacuum vessel, and there are practically no absorptions at the center of the plasma and on the periphery of the vessel. As stated earlier, such an electromagnetic wave energy absorption distribution of the plasma is easily found to lower the plasma temperature and density on the periphery, thus making the film thickness distribution on the wafer 04 nonuniform on the periphery. On the other hand, a look at FIG. 7(*b*) shows that when the current ratio of the coils is changed, absorptions on the periphery increase. As a result, the plasma on the periphery becomes higher in temperature and density, and so can be expected to produce a flatter film thickness distribution. As mentioned previously, a fall in the absorption distribution at the plasma center is generally self-corrected in a short time by diffusion of the plasma, and poses no problem.

As discussed above, the distribution of plasma can be further flattened by preparing a plurality of coils and adjusting electric currents flowing through the respective coils, in comparison with a loop antenna at a constant current ratio. Hence, electric currents fed to the coils (1*a*, 1*b*, 1*c*) or (1*a*, 1*b*, 1*g*) of the aforementioned power supply antenna I or II are adjusted, whereby a uniform electromagnetic wave can be generated, and the radial distribution of the plasma can be made more uniform. To vary the electric currents supplied to the coils (1*a*, 1*b*, 1*c*) or (1*a*, 1*b*, 1*g*) by a single high frequency power source, it is advisable to vary self inductances and mutual inductances. The self inductances and mutual inductances can be arbitrarily selected by adjusting the coil radii, coil thicknesses, etc. of the coils (1*a*, 1*b*, 1*c*) or (1*a*, 1*b*, 1*g*).

Figure 8:
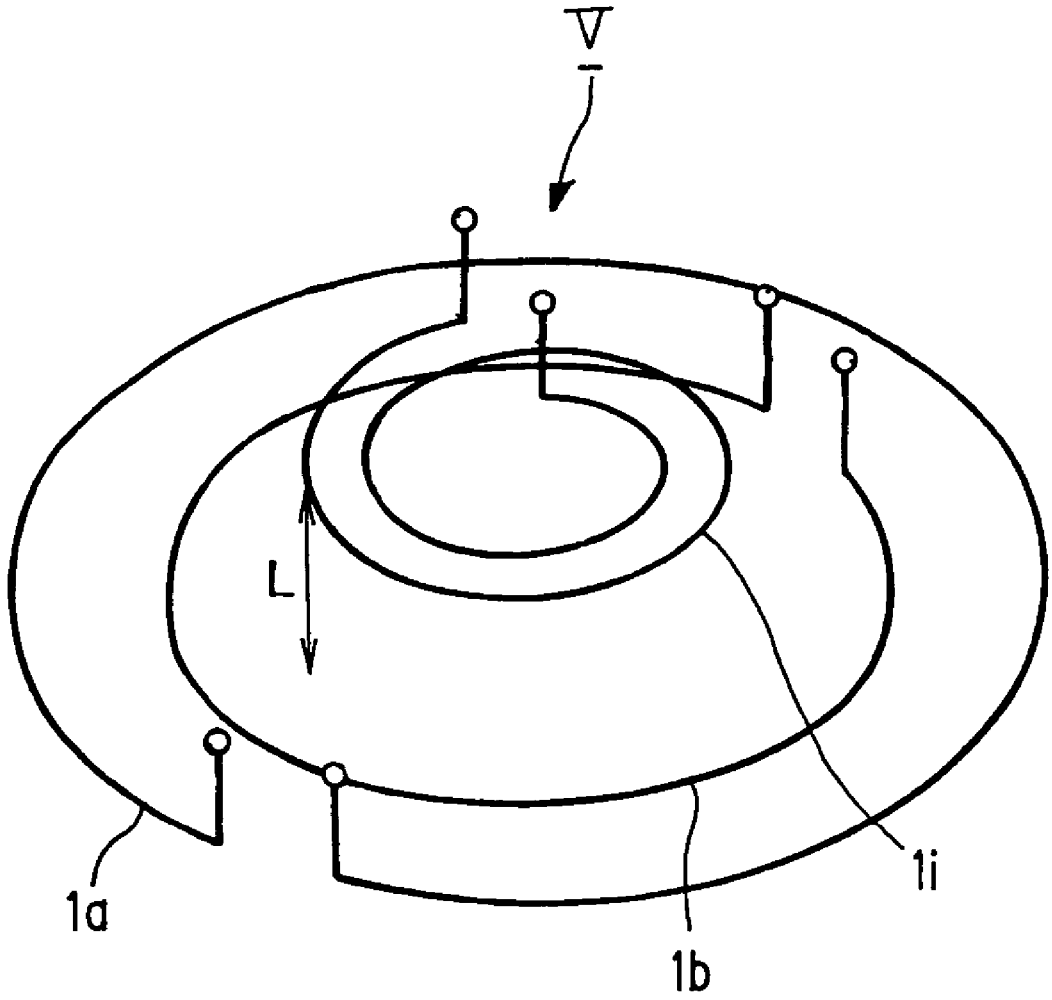
FIG. 8 is an explanation drawing conceptually showing a power supply antenna according to a third embodiment of the present invention.
Figure 9A:
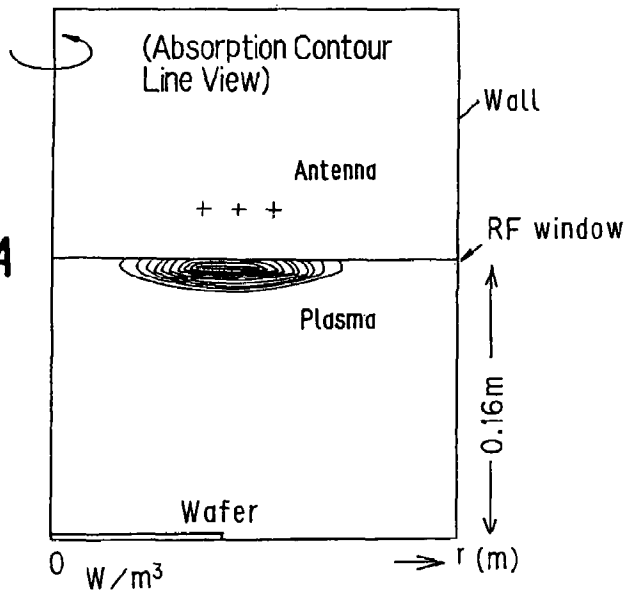
FIGS. 9(*a*) to 9(*d*) are characteristic views showing that the absorbed power characteristics depend on the positions of the coils of the power supply antenna.
Figure 9B:
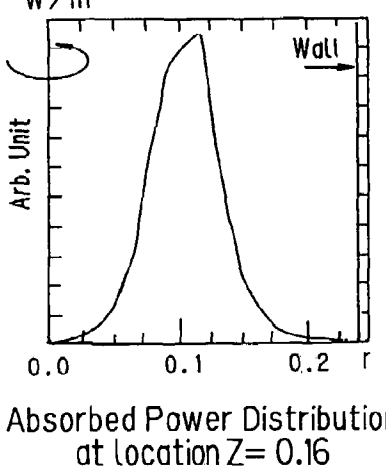
Figure 9C:
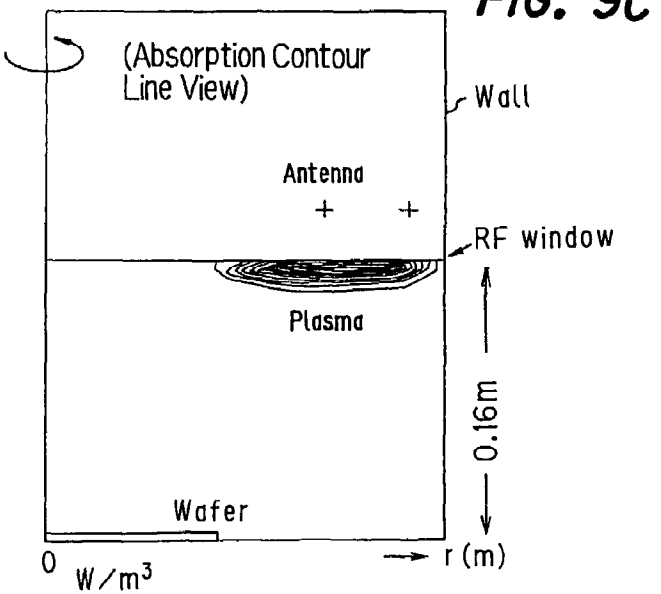
Figure 9D:
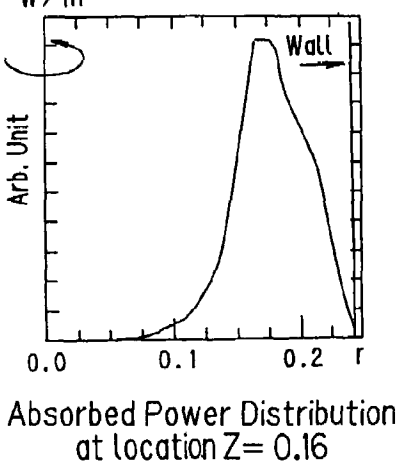

Uniformization of the radial (r-direction in FIG. 11) distribution of the plasma can also be achieved by a power supply antenna V, as shown in FIG. 8, which comprises a plurality of coils prepared by bending a plurality of conductors each into the form of an arc, and in which at least one of the coils, 1*i*, is disposed on a plane other than the plane where the other coils 1*a* and 1*b* are located, whereby the mutual inductances are varied to adjust the distribution of energy absorbed to the plasma. FIG. 8 shows that a horizontal surface including the vertical (Z-direction) position of the coil 1*i* is displaced by a distance L with respect to a horizontal surface including the vertical (Z-direction) positions of the other coils 1*a*, 1*b*. The coil 1*i* in the power supply antenna V is more distant from the plasma than the other coils 1*a*, 1*b*, thus weakening the absorption of an electromagnetic wave into the plasma. As a result, a heating distribution of the plasma can be shaped to achieve a uniform absorption distribution, thereby uniformizing the radial (redirection) distribution of the plasma. Of course, the coil 1*i* may be disposed closer to the plasma than the other coils 1*a*, 1*b*. In this case, absorption to the plasma can be intensified to achieve a uniform absorption distribution.

FIGS. 9(*a*) to 9(*d*) show the absorption distribution of a plasma when the position of the antenna is changed. FIGS. 9(*a*) and 9(*b*) represent a right-half region of the cylindrical vacuum vessel 02 shown in FIG. 11 which has been formed by cutting the vacuum vessel 02 with a vertical plane. The left half of the vacuum vessel 02 is axially symmetrical to the right half with respect to the vertical line at the left end in the drawings. FIGS. 9(*c*) and 9(*d*) are characteristic views showing the absorption power distribution characteristics corresponding to the data in FIGS. 9(*a*) and 9(*b*). The horizontal axis positions in FIGS. 9(*c*) and 9(*d*) correspond to the horizontal axis positions in FIGS. 9(*a*) and 9(*b*). In FIGS. 9(*a*) and 9(*b*), the plus (+) marks denote the positions of the coils. Reference to FIGS. 9(*a*), 9(*c*) and 9(*b*), 9(*d*) shows that the electromagnetic energy absorption of plasma concentrates directly below the antenna in which an electric current is flowing. Making use of this fact, one can adjust the positions of the plurality of coils (i.e., adjust the coil radii) to flatten the radial distribution of the electromagnetic wave absorption of the plasma.

Figure 11:
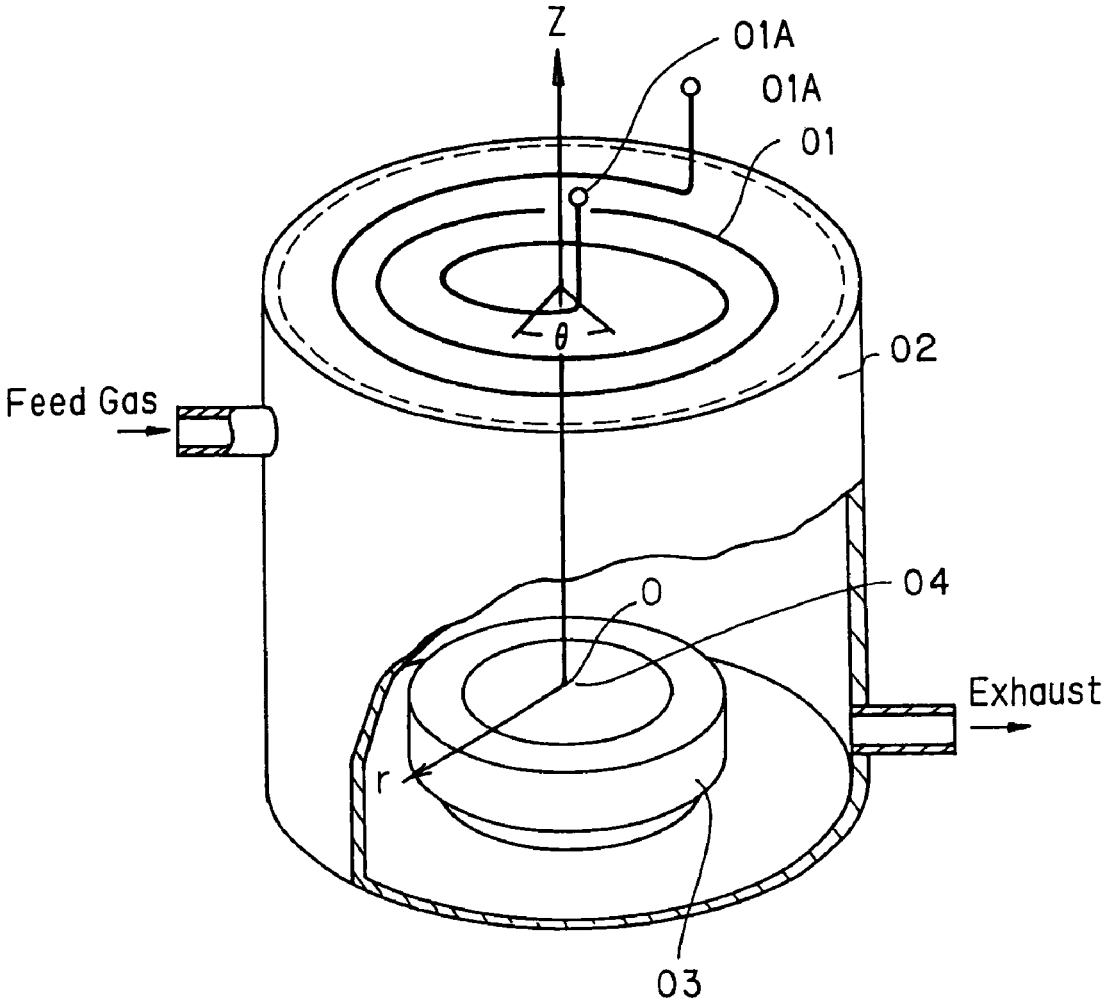
FIG. 11 PRIOR ART
FIG. 11 is an explanation drawing conceptually showing a power supply antenna according to an earlier technology together with a semiconductor manufacturing apparatus.
Figure 12:
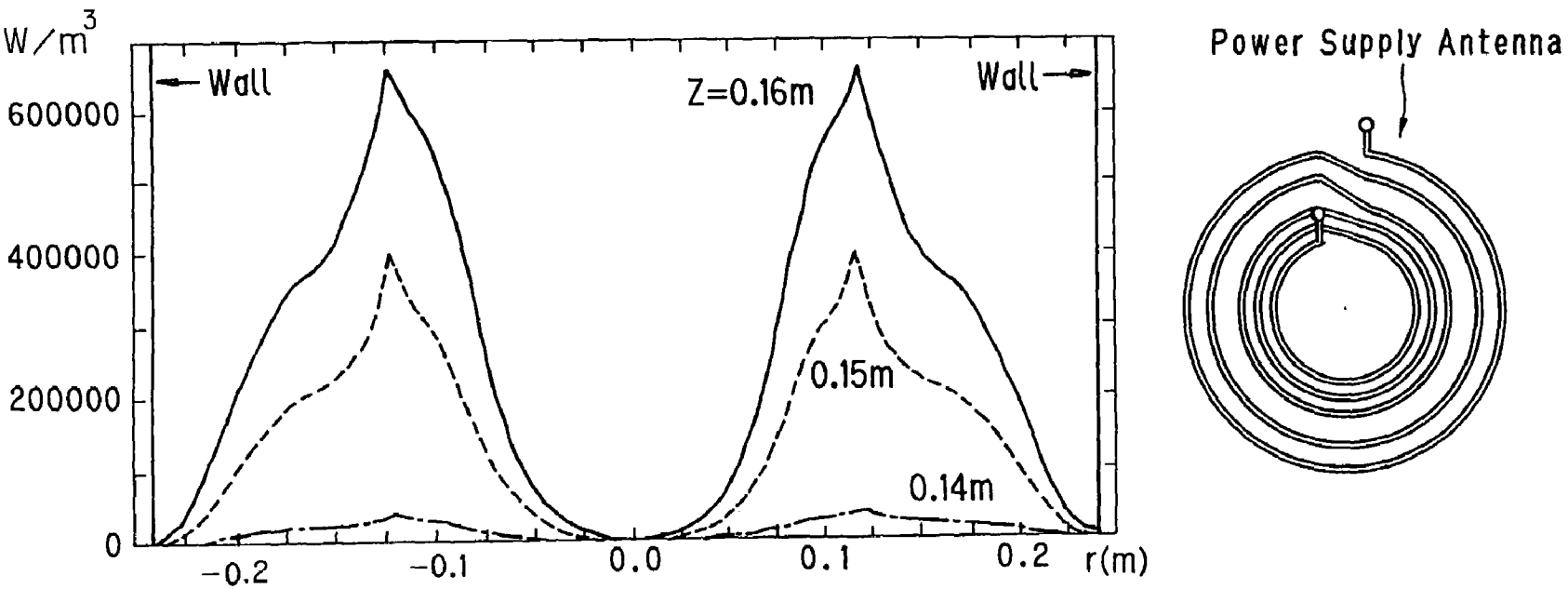
FIG. 12 PRIOR ART
FIG. 12 is a characteristic view showing absorbed power characteristics of the apparatus illustrated in FIG. 11.

A rule of physics demands that the θ-direction component of the electric field must be zero in a region near the wall of the metallic vacuum vessel 02 shown in FIG. 11. Thus, the electric field in this region necessarily weakens, and so the absorption to the plasma also decreases (see, for example, FIG. 12). To avoid this situation, a high frequency current of a relatively low frequency (e.g., several hundred kHz to several MHz) is supplied to the coil on the outermost periphery of the power supply antenna comprising a plurality of coils disposed concentrically, because an electromagnetic wave of a lower frequency generally penetrates deeper into a plasma. In detail, a high frequency current of a relatively low frequency is supplied to the coil on the outermost periphery of the power supply antenna, in consideration of the phenomenon shown in FIGS. 9(*a*) to 9(*d*), the phenomenon that the electromagnetic energy absorption of the plasma is the most prominent directly below the antenna. By so doing, the absorption can be increased, and the generation of a high temperature, high density plasma can be eventually expected even near the wall surface of the vacuum vessel 02. As a result, the film thickness in the peripheral portion of the wafer 04 can be flattened.

Figure 10:
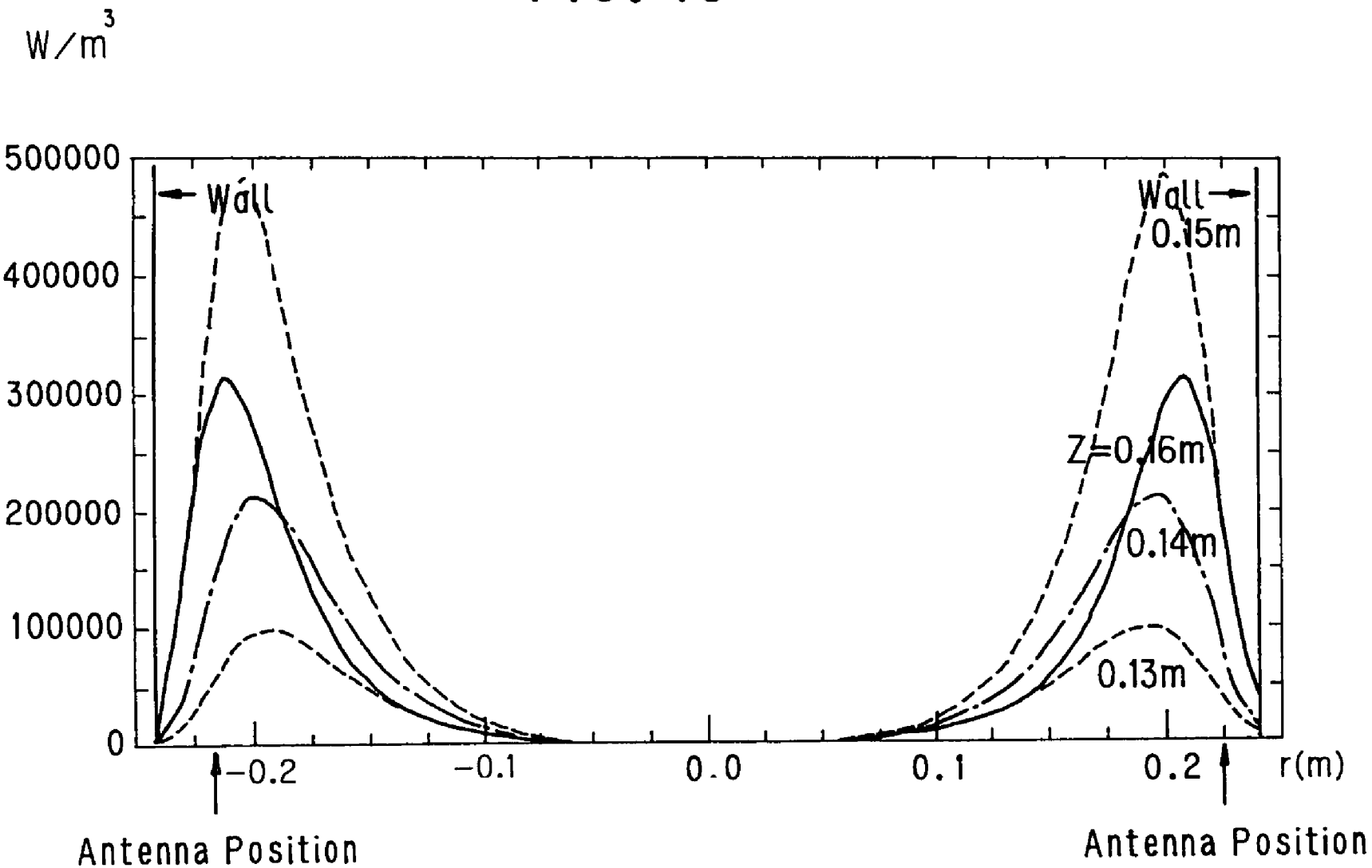
FIG. 10 is a characteristic view showing absorbed power characteristics exhibited when the coils of the power supply antenna were disposed near the wall of a vacuum vessel.

FIG. 10 shows the absorbed power distribution characteristics of a plasma exhibited when the antenna is located at a position close to the wall and with the radius of 0.22 (m), and is supplied with a high frequency current of 0.4 MHz. In this case, the power absorption is localized in the region near the wall, and the power enters deep into the plasma. Thus, a high frequency current of a relatively low frequency is supplied to the coil on the outermost periphery, as stated above, whereby the characteristics shown in FIG. 10 can be obtained in correspondence with the position of the coil on the outermost periphery. If these characteristics are superposed, for example, onto the characteristics shown in FIG. 12, it is possible to obtain absorption characteristics which have repaired falls in the plasma temperature and density in the region close to the wall of the vacuum vessel 02. Such actions and effects can be obtained by using a power supply apparatus including plural types of power sources for supplying high frequency voltages of different frequencies, and wherein the high frequency power source for an output voltage of the lowest frequency is connected to the coil on the outermost periphery, and the high frequency power source for an output voltage of a relatively high frequency is connected to the other coil.

As clear from the foregoing explanations, the power supply antenna of the present invention may fulfill the minimum requirement that it be composed of a plurality of concentrically disposed coils formed from a plurality of conductors each bent in the form of an arc. When the plurality of coils are arranged independently in this manner, the self and mutual inductances of the respective coils can be adjusted arbitrarily to adjust the values of high frequency currents supplied to the respective coils. Where necessary, the frequencies of the high frequency currents supplied to the respective coils can also be selected arbitrarily. In this case, however, if the power supply portions 01*e*, 01*d*, 01*f* are concentrated in one region as shown in FIG. 1, disturbances in the electric field and the magnetic field are also concentrated in this region. As shown in FIGS. 2 and 3, therefore, it is, needless to say, more preferred to arrange the power supply portions with their phases being shifted in the circumferential direction.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A power supply apparatus comprising:

a power supply antenna comprising a plurality of coils disposed concentrically, the plurality of coils being prepared by bending a plurality of conductors each into a form of an arc; and matching means having capacitors connected in parallel to the respective coils of the power supply antenna, and wherein the matching means has a first tubular capacitor and a second tubular capacitor each having electrodes at axially opposite ends thereof, and also has a first electrode, a second electrode and a third electrode disposed parallel to the power supply antenna, with electrical insulation being established with respect to each other, one of the electrodes of the first capacitor being connected to the first electrode, one of the electrodes of the second capacitor being connected to the second electrode, and the other electrodes of the first and second capacitors being connected to the third electrode, the first electrode and the third electrode are disposed at opposite ends thereof, the second electrode comprising a flat plate portion having through-holes and a concave portion protruding from the flat plate portion toward the first electrode is disposed between the first electrode and the third electrode, the first capacitor passes through the through-hole and has one of the electrodes thereof connected to the first electrode, the second capacitor fits into the concave portion and has one of the electrodes thereof connected to the second electrode, and at least one of power supply portions of each of the coils constituting the power supply antenna passes through at least the first electrode and establishes an electrically connected relationship with the second electrode.

2. The power supply apparatus of claim 1, wherein the power supply antenna comprises a plurality of coils disposed concentrically, the plurality of coils being prepared by bending a plurality of conductors each into a form of an arc, and power supply portions formed at opposite ends of the respective coils so as to be connected to a high frequency power source are located in different phases on a same plane.

3. The power supply apparatus of claim 1, wherein the power supply antenna comprises a plurality of coils disposed concentrically, the plurality of coils being prepared by bending a plurality of conductors each into a form of an arc, power supply portions formed at opposite ends of the respective coils so as to be connected to a high frequency power source are located in different phases on a same plane, and radii or thicknesses of the respective coils are adjusted to vary self inductances and mutual inductances, thereby varying electric currents flowing through the respective coils so that a distribution of energy absorbed to a plasma can be adjusted.

4. The power supply apparatus of claim 1, wherein the power supply antenna comprises a plurality of coils disposed concentrically, the plurality of coils being prepared by bending a plurality of conductors each into a form of an arc, power supply portions formed at opposite ends of the respective coils so as to be connected to a high frequency power source are located in different phases on a same plane, and at least one of the coils is disposed on a plane other than the same plane to vary mutual inductances so that a distribution of energy absorbed to a plasma is adjusted.

5. The power supply apparatus of claim 1, wherein the power supply antenna comprises a plurality of coils disposed concentrically, the plurality of coils being prepared by bending a plurality of conductors each into a form of an arc, power supply portions formed at opposite ends of the respective coils so as to be connected to a high frequency power source are located in different phases on a same plane, and spacing between the adjacent power supply portions in the respective coils is equal.

6. The power supply apparatus of claim 1, including a plurality of types of power sources for supplying high frequency voltages of different frequencies, and wherein the high frequency power source for an output voltage of the lowest frequency is connected to the coil on an outermost periphery, and the high frequency power source for an output voltage of a relatively high frequency is connected to the other coil.

7. A semiconductor manufacturing apparatus comprising:

a vessel having an electromagnetic wave transparent window;

a power supply antenna provided outside the vessel and opposed to the electromagnetic wave transparent window; and a power source for applying a high frequency voltage to the power supply antenna, and being adapted to apply the high frequency voltage from the power source to the power supply antenna to generate an electromagnetic wave, and pass the electromagnetic wave through the electromagnetic wave transparent window into the vessel to generate a plasma, thereby treating a surface of a substrate in the vessel, and further including a power supply apparatus comprising:

the power supply antenna comprising a plurality of coils disposed concentrically, the plurality of coils being prepared by bending a plurality of conductors each into a form of an arc; and matching means having capacitors connected in parallel to the respective coils of the power supply antenna, and configured such that the matching means has a first tubular capacitor and a second tubular capacitor each having electrodes at axially opposite ends thereof, and also has a first electrode, a second electrode and a third electrode disposed parallel to the power supply antenna, with electrical insulation being established with respect to each other, one of the electrodes of the first capacitor being connected to the first electrode, one of the electrodes of the second capacitor being connected to the second electrode, and the other electrodes of the first and second capacitors being connected to the third electrode, the first electrode and the third electrode are disposed at opposite ends thereof, the second electrode comprising a flat plate portion having through-holes and a concave portion protruding from the flat plate portion toward the first electrode is disposed between the first electrode and the third electrode, the first capacitor passes through the through-hole and has one of the electrodes thereof connected to the first electrode, the second capacitor fits into the concave portion and has one of the electrodes thereof connected to the second electrode, and at least one of power supply portions of each of the coils constituting the power supply antenna passes through at least the first electrode and establishes an electrically connected relationship with the second electrode.

8. The semiconductor manufacturing apparatus of claim 7, including a plurality of types of power sources for supplying high frequency voltages of different frequencies, and wherein the high frequency power source for an output voltage of the lowest frequency is connected to the coil on an outermost periphery, and the high frequency power source for an output voltage of a relatively high frequency is connected to the other coil.

* * * * *